US007559549B2

(12) United States Patent
Clark et al.

(10) Patent No.: US 7,559,549 B2
(45) Date of Patent: Jul. 14, 2009

(54) MEDIA FEEDER FEED RATE

(75) Inventors: Robert A. Clark, Williamson, NY (US); Kenneth P. Moore, Rochester, NY (US); Bruce A. Thompson, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 292 days.

(21) Appl. No.: 11/643,119

(22) Filed: Dec. 21, 2006

(65) Prior Publication Data

US 2008/0150218 A1 Jun. 26, 2008

(51) Int. Cl.
*B65H 5/34* (2006.01)

(52) U.S. Cl. ..... 271/270

(58) Field of Classification Search ..... 271/11, 271/10.01, 10.11, 10.16, 270
See application file for complete search history.

(56) References Cited

U.S. PATENT DOCUMENTS 4,030,723 A * 6/1977 Irvine et al. ..... 271/11
4,050,690 A * 9/1977 Michelson ..... 271/125
4,280,691 A * 7/1981 Blum ..... 271/11
4,451,027 A * 5/1984 Alper ..... 271/10.02
4,548,395 A * 10/1985 Snellman et al. ..... 271/11
4,579,446 A 4/1986 Fujino et al.
4,587,532 A 5/1986 Asano
4,828,244 A * 5/1989 Sardella ..... 271/11
4,836,119 A 6/1989 Siraco et al.
4,896,872 A * 1/1990 Sardella ..... 271/11
5,004,222 A 4/1991 Dobashi
5,008,713 A 4/1991 Ozawa et al.
5,050,852 A * 9/1991 Sawada et al. ..... 271/11
5,080,340 A 1/1992 Hacknauer et al.
5,095,342 A 3/1992 Farrell et al.
5,101,241 A 3/1992 Watanabe
5,146,286 A 9/1992 Rees et al.
5,159,395 A 10/1992 Farrell et al.
5,172,898 A * 12/1992 Takahashi ..... 271/10.11
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox (Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David H Bollinger
(74) *Attorney, Agent, or Firm*—Eugene O. Palazzo; Fay Sharpe, LLP

(57) ABSTRACT

In accordance with the present disclosure, there is provided a printing system. The printing system comprises a sheet feeding apparatus for feeding cut sheets in timed relationship into a sheet processor having a pitch. The sheet feeding apparatus includes a fixed take away roller, a first transport roller, and a second transport roller. The take away roller removes individual sheets from a feeder. A fixed length sheetpath exists between the take away roller, the first transport roller, and the second transport roller. The take away roller and/or optionally the first transport roller have a variable speed capability to vary the velocity thereof.

22 Claims, 3 Drawing Sheets

U.S. PATENT DOCUMENTS 5,557,367 A 9/1996 Yang et al.
5,560,595 A 10/1996 Kulpa
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,826,157 A * 10/1998 Wierszewski ..... 399/396
5,884,910 A 3/1999 Mandel
5,941,518 A 8/1999 Sokac et al.
5,995,721 A 11/1999 Rourke et al.
6,059,284 A 5/2000 Wolf et al.
6,125,248 A 9/2000 Moser
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,783,290 B2 * 8/2004 Sussmeier ..... 400/608.4
6,819,906 B1 11/2004 Herrmann et al.
6,925,283 B1 8/2005 Mandel et al.
6,959,165 B2 10/2005 Mandel et al.
6,973,286 B2 12/2005 Mandel et al.
7,024,152 B2 4/2006 Lofthus et al.
7,123,873 B2 10/2006 deJong et al.
7,293,769 B2 * 11/2007 Asari et al. ..... 271/258.01
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2005/0046102 A1 * 3/2005 Asari et al. ..... 271/10.01
2006/0012102 A1 1/2006 Lofthus et al.
2006/0033771 A1 2/2006 Lofthus et al.
2006/0039729 A1 2/2006 Mandel et al.
2006/0066885 A1 3/2006 Anderson et al.
2006/0067756 A1 3/2006 Anderson et al.
2006/0067757 A1 3/2006 Anderson et al.
2006/0114313 A1 6/2006 Moore
2006/0114497 A1 6/2006 Anderson et al.
2006/0115284 A1 6/2006 Grace et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0197966 A1 9/2006 Viturro et al.
2006/0209101 A1 9/2006 Mizes
2006/0214359 A1 9/2006 Clark
2006/0214364 A1 9/2006 Clark et al.
2006/0215240 A1 9/2006 Mongeon
2006/0221159 A1 10/2006 Moore et al.
2006/0221362 A1 10/2006 Julien et al.
2006/0222378 A1 10/2006 Julien
2006/0222384 A1 10/2006 Moore et al.
2006/0222393 A1 10/2006 de Jong et al.
2006/0227350 A1 10/2006 Crawford et al.
2006/0230201 A1 10/2006 Fromherz et al.
2006/0230403 A1 10/2006 Crawford et al.
2006/0233569 A1 10/2006 Furst et al.
2006/0235547 A1 10/2006 Hindi et al.
2006/0238778 A1 10/2006 Mongeon et al.
2006/0244980 A1 11/2006 Grace
2006/0250636 A1 11/2006 Richards

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/109,566, filed Apr. 19,2005, Mandel et al.
U.S. Appl. No. 11/136,959, filed May 25, 2005, German et al.
U.S. Appl. No. 11/137,634, filed May 25, 2005, Lofthus et al.
U.S. Appl. No. 11/137,251, filed May 25, 2005. Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.

U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.
U.S. Appl. No. 11/522,171, filed Sep. 15, 2006, Sampath et al.
U.S. Appl. No. 11/528,770, filed Sep. 27, 2006, Degruchy.
U.S. Appl. No. 11/545,176, filed Oct. 10, 2006, deJong et al.
U.S. Appl. No. 11/595,630, filed Nov. 9, 2006, Moore.
U.S. Appl. No. 11/590,432, filed Oct. 31, 2006, Moore.
U.S. Appl. No. 60/631,651, filed Nov. 30, 2004, Anderson, et al.
U.S. Appl. No. 60/631,918, filed Nov. 30, 2004, Anderson, et al.
U.S. Appl. No. 60/631,921, filed Nov. 30, 2004, Anderson et al.

* cited by examiner

MEDIA FEEDER FEED RATE

BACKGROUND

This disclosure relates to a sheet feeder, and more particularly concerns a sheet feeder with a fixed length, variable speed sheetpath for use with integrated electrophotographic printing machines.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Substantially, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, sheet feeders having a high capacity are utilized to supply sheets to the machine processor. Substantially these sheet stacks are supported on an elevator mechanism for supply to a fixed feedhead. The feedhead then forwards individual sheets along a fixed input path in a timed relation to the printing processor. These elevator mechanisms require a relatively high power motor to drive the sheet stack to the feedhead.

In other applications, a feeder device can be utilized wherein the sheet stack remains fixed and the feedhead moves as the sheet stack is depleted. However, when a feedhead is not fixed the length of the input path from the feedhead to the processor must be variable and the timing must then be corrected for the sheets as the path length changes. In this configuration, it can be desirable to have a variable length, variable speed sheetpath to maintain the proper timed relationship between sheets as the sheet stack is depleted.

The following disclosures may be relevant to various aspects of the present disclosure: U.S. Pat. No. 5,146,286 to patentee Rees et al., issued Sep. 8, 1992; U.S. Pat. No. 5,101,241 to patentee Watanabe, issued Mar. 31, 1992; and, U.S. Pat. No. 5,941,5.18 to patentee: Sokac et al., issued Aug. 24, 1999.

The relevant portions of the foregoing disclosures may be briefly summarized as follows:

U.S. Pat. No. 5,146,286 describes a device in which sheets are fed and stacked in the same device. A feeder having a fixed stacking tray is used with a floating feedhead in which the feedhead is connected to a stacking tray above the loading tray. As a sheet stack is depleted the finished sheets are discharged onto a stacking tray immediately above the sheet holding tray for an efficient use of space.

U.S. Pat. No. 5,101,241 discloses a sorter having an assortment of trays for receiving sheets. Sheets are directed to each tray by a moveable sheetpath from a processor to each tray.

U.S. Pat. No. 5,941,518 describes a device which includes a floating feedhead having a variable sheetpath for an electrophotographic printing machine. When the sheetpath is at its longest the feedhead and variable drive member operate at a higher speed to deliver the sheets to the sheet intake area at a predetermined time interval. As sheets are fed and the sheetpath becomes shorter, the variable drive and feedhead slow to maintain proper sheet timing. The sheetpath may also include a telescopic baffle configuration.

CROSS REFERENCE TO RELATED APPLICATIONS

The following patents/applications, the disclosures of each being totally incorporated herein by reference are mentioned: U.S. Publication No. US-2006-0114497-A1, Published Jun. 1, 2006, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES"; U.S. Publication No. US-2006-0067756-A1, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE"; U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE"; U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.; U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.; U.S. Application No. US-2006-0012102-A1, published Jan. 19, 2006, entitled "FLEXIBLE PAPER PATH USING MULTIDIRECTIONAL PATH MODULES," by Daniel G. Bobrow; U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.; U.S. Publication No. US-2006-0033771-A1, published Feb. 16, 2006, entitled "PARALLEL PRINTING ARCHITECTURE HAVING CONTAINER- IZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.; U.S. Pat. No. 7,123,873, issued Oct. 17, 2006, entitled "PRINTING SYSTEM WITH INVERTER DISPOSED FOR MEDIA VELOCITY BUFFERING AND REGISTRATION," by Joannes N. M. dejong, et al.; U.S. application Ser. No. 10/924,458, filed Aug. 23, 2004, entitled "PRINT SEQUENCE SCHEDULING FOR RELIABILITY," by Robert M. Lofthus, et al.; U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.; U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.; U.S. application Ser. No. 10/933,556, filed Sep. 3, 2004, entitled "SUBSTRATE INVERTER SYSTEMS AND METHODS," by Stan A. Spencer, et al.; U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.; U.S. Publication No. US-2006-0115284-A1, Published Jun. 1, 2006, entitled "SEMI-AUTOMATIC IMAGE QUALITY ADJUSTMENT FOR MULTIPLE MARKING ENGINE SYSTEMS," by Robert E. Grace, et al.; U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. Publication No. US-2006-0115287-A1, Published Jun. 1, 2006, entitled "GLOSSING SYSTEM FOR USE IN A TIPP ARCHITECTURE," by Bryan J. Roof; U.S. application Ser. No. 11/000,168, filed Nov. 30, 2004, entitled "ADDRESSABLE FUSING AND HEATING METHODS AND APPARATUS," by David K. Biegelsen, et al.; U.S. Publication No. US-2006-0115288-A1, Published Jun. 1, 2006, entitled "GLOSSING SYSTEM FOR USE IN A TIPP ARCHITECTURE," by Bryan J. Roof; U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.; U.S. Publication No. US-2006-0176336-A1, Published Aug. 10, 2006, entitled "PRINTING SYSTEMS," by Steven R. Moore, et al.; U.S. Publication No. US-2006-0132815-A1, Published Jun. 22, 2006, entitled "PRINTING SYSTEMS," by Robert M. Lofthus, et al.; U.S. Publication No. US-2006-0197966-A1, Published Sep. 7, 2006, entitled "GRAY BALANCE FOR A PRINTING SYSTEM OF MULTIPLE MARKING ENGINES," by R. Enrique Viturro, et al.; U.S. Publication No. US-2006-0114313-A1, Published Jun. 1, 2006, entitled "PRINTING SYSTEM," by Steven R. Moore; U.S. Publication No. US-2006-0209101-A1, Published Sep. 21, 2006, entitled "SYSTEMS AND METHODS FOR MEASURING UNIFORMITY IN IMAGES," by Howard Mizes; U.S. Publication No. US-2006-0214364-A1, Published Sep. 28, 2006, entitled "SHEET REGISTRATION WITHIN A MEDIA INVERTER," by Robert A. Clark, et al.;

U.S. Publication No. US-2006-0214359-A1, Published Sep. 28, 2006, entitled "INVERTER WITH RETURN/BY-PASS PAPER PATH," by Robert A. Clark; U.S. Publication No. 20031468-US-NP, Published Sep. 28, 2006, entitled IMAGE QUALITY CONTROL METHOD AND APPARATUS FOR MULTIPLE MARKING ENGINE SYSTEMS," by Michael C. Mongeon; U.S. Publication No. US-2006-0222378-A1, Published Oct. 5, 2006, entitled "PRINTING SYSTEM," by Paul C. Julien;

U.S. Publication No. US-2006-0221362-A1, Published Oct. 5, 2006, entitled "PRINTING SYSTEM," by Paul C. Julien; U.S. Publication No. US-2006-0222393-A1, Published Oct. 5, 2006, entitled "PRINTING SYSTEM," by Jeremy C. deJong, et al.; U.S. Publication No. US-2006-0222384-A1, Published Oct. 5, 2006, entitled "IMAGE ON PAPER REGISTRATION ALIGNMENT," by Steven R. Moore, et al.; U.S. Publication No. US-2006-0221159-A1, Published Oct. 5, 2006, entitled "PARALLEL PRINTING ARCHITECTURE WITH PARALLEL HORIZONTAL PRINTING MODULES," by Steven R. Moore, et al.; U.S. Publication No. US-2006-0227350-A1, Published Oct. 12, 2006, entitled "SYNCHRONIZATION IN A DISTRIBUTED SYSTEM," by Lara S. Crawford, et al.; U.S. Publication No. US-2006-0230403-A1, Published Oct. 12, 2006, entitled "COORDINATION IN A DISTRIBUTED SYSTEM," by Lara S. Crawford, et al.; U.S. Publication No. US-2006-0230201-A1, Published Oct. 12, 2006, entitled "COMMUNICATION IN A DISTRIBUTED SYSTEM," by Markus P. J. Fromherz, et al.; U.S. Publication No. US-2006-0235547-A1, published Oct. 19, 2006, entitled "ON-THE-FLY STATE SYNCHRONIZATION IN A DISTRIBUTED SYSTEM," by Haitham A. Hindi;

U.S. Publication No. US-2006-0233569-A1, filed Oct. 19, 2006, entitled "SYSTEMS AND METHODS FOR REDUCING IMAGE REGISTRATION ERRORS," by Michael R. Furst, et al.; U.S. application Ser. No. 11/109,566, filed Apr. 19, 2005, entitled "MEDIA TRANSPORT SYSTEM," by Barry P. Mandel, et al.; U.S. Publication No. US-2006-0238778-A1, Published Oct. 26, 2006, entitled "PRINTING SYSTEMS," by Michael C. Mongeon, et al.; U.S. Publication No. US-2006-0244980-A1, Filed Apr. 27, 2005, entitled "IMAGE QUALITY ADJUSTMENT METHOD AND SYSTEM," by Robert E. Grace; U.S. Publication No. US-2006-0250636-A1, published Nov. 9, 2006, entitled "PRINTING SYSTEM AND SCHEDULING METHOD," by Austin L. Richards; U.S. application Ser. No. 11/136,959, filed May 25, 2005, entitled "PRINTING SYSTEMS," by Kristine A. German, et al.; U.S. application Ser. No. 11/137,634, filed May 25, 2005, entitled "PRINTING SYSTEM," by Robert M. Lofthus, et al.; U.S. application Ser. No. 11/137,251, filed May 25, 2005, entitled "SCHEDULING SYSTEM," by Robert M. Lofthus, et al.; U.S. Publication No. US-2006-0066885-A1, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.; U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.; U.S. application Ser. No. 11/156,778, filed Jun. 20, 2005, entitled "PRINTING PLATFORM," by Joseph A. Swift; U.S. application Ser. No. 11/157,598, filed Jun. 21, 2005, entitled "METHOD OF ORDERING JOB QUEUE OF MARKING SYSTEMS," by Neil A. Frankel; U.S. application Ser. No. 11/166,460, filed Jun. 24, 2005, entitled "GLOSSING SUBSYSTEM FOR A PRINTING DEVICE," by Bryan J. Roof, et al.; U.S. application Ser. No. 11/166,581, filed Jun. 24, 2005, entitled "MIXED OUTPUT PRINT CONTROL METHOD AND SYSTEM," by Joseph H. Lang, et al.; U.S. application Ser. No. 11/166,299, filed Jun. 24, 2005, entitled "PRINTING SYSTEM," by Steven R. Moore; U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen; U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen; U.S. application Ser. No. 11/170,845, filed Jun. 30, 2005, entitled "HIGH AVAILABILITY PRINTING SYSTEMS," by Meera Sampath, et al.; U.S. application Ser. No. 11/189,371, filed Jul. 26, 2005, entitled "PRINTING SYSTEM," by Steven R. Moore, et al.; U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.; U.S. application Ser. No. 11/215,791, filed Aug. 30, 2005, entitled "CONSUMABLE SELECTION IN A PRINTING SYSTEM," by Eric Hamby, et al.; U.S. application Ser. No. 11/222,260, filed Sep. 8, 2005, entitled "METHOD AND SYSTEMS FOR DETERMINING BANDING COMPENSATION PARAMETERS IN PRINTING SYSTEMS," by Goodman, et al.; U.S. application Ser. No. 11/234,553, filed Sep. 23, 2005, entitled "MAXIMUM GAMUT STRATEGY FOR THE PRINTING SYSTEMS," by Michael C. Mongeon; U.S. application Ser. No. 11/234,468, filed Sep. 23, 2005, entitled "PRINTING SYSTEM," by Eric Hamby, et al.; U.S. application Ser. No. 11/247,778, filed Oct. 11, 2005, entitled "PRINTING SYSTEM WITH BALANCED CONSUMABLE USAGE," by Charles Radulski, et al.; U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/274,638, filed Nov. 15, 2005, entitled "GAMUT SELECTION IN MULTI-ENGINE SYSTEMS," by Wencheng Wu, et al.; U.S. application Ser. No. 11/287,177, filed Nov. 23, 2005, entitled "MEDIA PASS THROUGH MODE FOR MULTI-ENGINE SYSTEM," by Barry P. Mandel, et al.; U.S. application Ser. No. 11/287,685, filed Nov. 28, 2005, entitled "MULTIPLE IOT PPHOTORECEPTOR BELT SEAM SYNCHRONIZATION," by Kevin M. Carolan;

U.S. application Ser. No. 11/291,860, filed Nov. 30, 2005, entitled "MEDIA PATH CROSSOVER CLEARANCE FOR PRINTING SYSTEM," by Keith L. Willis; U.S. application Ser. No. 11/292,388, filed Nov. 30, 2005, entitled "PRINTING SYSTEM," by David A. Mueller; U.S. application Ser. No. 11/292,163, filed Nov. 30, 2005, entitled "RADIAL MERGE MODULE FOR PRINTING SYSTEM," by Barry P. Mandel, et al.; U.S. application Ser. No. 11/291,583, filed Nov. 30, 2005, entitled "MIXED OUTPUT PRINTING SYSTEM," by Joseph H. Lang; U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.; U.S. application Ser. No. 11/314,828, filed Dec. 21, 2005, entitled "MEDIA PATH DIAGNOSTICS WITH HYPER MODULE ELEMENTS," by David G. Anderson, et al; U.S. application Ser. No. 11/314,774, filed Dec. 21, 2005, entitled "METHOD AND APPARATUS FOR MULTIPLE PRINTER CALIBRATION USING COMPROMISE AIM," by R. Victor Klassen; U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.; U.S. application Ser. No. 11/317,167, filed Dec. 23, 2005, entitled "PRINTING SYSTEM," by Robert M. Lofthus, et al.; U.S. application Ser. No. 11/331,627, filed Jan. 13, 2006, entitled "PRINTING SYSTEM INVERTER APPARATUS", by Steven R. Moore; U.S. application Ser. No. 11/341,733, filed Jan. 27, 2006, entitled "PRINTING SYSTEM AND BOTTLENECK OBVIATION", by Kristine A. German; U.S. application Ser. No. 11/349,828, filed Feb. 8, 2005, entitled "MULTI-DEVELOPMENT SYSTEM PRINT ENGINE", by Martin E. Banton; U.S. application Ser. No. 11/359,065, filed Feb. 22, 2005, entitled "MULTI-MARKING ENGINE PRINTING PLATFORM", by Martin E. Banton; U.S. application Ser. No. 11/363,378, filed Feb. 27, 2006, entitled "SYSTEM FOR MASKING PRINT DEFECTS", by Anderson, et al.; U.S. application Ser. No. 11/364,685, filed Feb. 28, 2006, entitled "SYSTEM AND METHOD FOR MANUFACTURING SYSTEM DESIGN AND SHOP SCHEDULING USING NETWORK FLOW MODELING", by Hindi, et al.; U.S. application Ser. No. 11/378,046, filed Mar. 17, 2006, entitled "PAGE SCHEDULING FOR PRINTING ARCHITECTURES", by Charles D. Rizzolo, et al.; U.S. application Ser. No. 11/378,040, filed Mar. 17, 2006, entitled "FAULT ISOLATION OF VISIBLE DEFECTS WITH MANUAL MODULE SHUTDOWN OPTIONS", by Kristine A. German, et al.; U.S. application Ser. No. 11/399,100, filed Apr. 6, 2006, entitled "SYSTEMS AND METHODS TO MEASURE BANDING PRINT DEFECTS", by Peter Paul; U.S. application Ser. No. 11/403,785, filed Apr. 13, 2006, entitled "MARKING ENGINE SELECTION", by Martin E. Banton et al.; U.S. application Ser. No. 11/417,411, filed May 4, 2006, entitled "DIVERTER ASSEMBLY, PRINTING SYSTEM AND METHOD ", by Paul J. Degruchy; U.S. application Ser. No. 11/432,993, filed May 12, 2006, entitled "TONER SUPPLY ARRANGEMENT", by David G. Anderson; U.S. application Ser. No. 11/432,924, filed May 12, 2006, entitled "AUTOMATIC IMAGE QUALITY CONTROL OF MARKING PROCESSES", by David J. Lieberman; U.S. application Ser. No. 11/432,905, filed May 12, 2006, entitled "PROCESS CONTROLS METHODS AND APPARATUSES FOR IMPROVED IMAGE CONSISTENCY", by Michael C. Mongeon et al.; U.S. application Ser. No. 11/474,247, filed Jun. 23, 2006, entitled "CONTINUOUS FEED PRINTING SYSTEM", by Steven R. Moore; U.S. application Ser. No. 11/483,747, filed Jul. 6, 2006, entitled "POWER REGULATOR OF MULTIPLE MARKING ENGINES", by Murray O. Meetze, Jr.; U.S. application Ser. No. 11/485,870, filed Jul.

13, 2006, entitled "PARALLEL PRINTING SYSTEM", by Steven R. Moore; U.S. application Ser. No. 11/487,206, filed Jul. 14, 2006, entitled "BANDING AND STREAK DETECTION USING CUSTOMER DOCUMENTS", by Wencheng Wu, et al.; U.S. application Ser. No. 11/495,017, filed Jul. 28, 2006, entitled "SYSTEM AND METHOD FOR PARTIAL JOB INTERRUPT OF NORMAL ORDER OF JOB QUEUE OF MARKING SYSTEMS", by Lloyd F. Bean, II; U.S. application Ser. No. 11/501,654, filed Aug. 9, 2006, entitled "METHOD FOR SPATIAL COLOR CALIBRATION USING HYBRID SENSING SYSTEMS", by Lalit Keshav Mestha et al.; U.S. application Ser. No. 11/522,171, filed Sep. 15, 2006, entitled "FAULT MANAGEMENT FOR A PRINTING SYSTEM", by Meera Sampath, et al.; U.S. application Ser. No. 11/528,770, filed Sep. 27, 2006, entitled "SHEET BUFFERING SYSTEM", by Paul DeGruchy; U.S. application Ser. No. 11/545,176, filed Oct. 10, 2006, entitled "PRINTING SYSTEM WITH INVERTER DISPOSED FOR MEDIA VELOCITY BUFFERING AND REGISTRATION", by Joannes N. M. Dejong et al. U.S. application Ser. No. 11/590,432, filed Oct. 31, 2006, entitled "SHAFT DRIVING APPARATUS", by Steven R. Moore; U.S. application Ser. No. 11/595,630, filed Nov. 9, 2006, entitled "PRINT MEDIA ROTARY TRANSPORT APPARATUS AND METHOD", by Steven R. Moore; U.S. application Ser. No. 11/636,901, filed Dec. 11, 2006, entitled "DATA BINDING IN MULTIPLE MARKING ENGINE PRINTING SYSTEMS BACKGROUND", by Martin E. Banton et al.; U.S. application Ser. No. 11/639,073, filed Dec. 14, 2006, entitled "MODULE IDENTIFICATION METHOD AND SYSTEM FOR PATH CONNECTIVITY IN MODULAR SYSTEMS", by David K. Biegelsen et al.

BRIEF DESCRIPTION

Aspects of the present disclosure in embodiments thereof include a printing system comprising a sheet feeding apparatus for feeding cut sheets in timed relationship into a sheet processor having a pitch. The sheet feeding apparatus includes a fixed take away roller, a first transport roller, and a second transport roller. The take away roller removes individual sheets from a feeder. A fixed length sheetpath exists between the take away roller, the first transport roller, and the second transport roller. The take away roller and the first transport roller are independently variably driven between a first velocity, a second velocity, and a third velocity. The second transport roller is driven at the third velocity.

The present disclosure in embodiments thereof further provides a control system for feeding media. The control system comprises a take away roller for removing the media from a feed tray at a first velocity. The system further comprises a first transport roller for transporting the media from the take away roller to a second transport roller wherein the feeding of the media from the take away roller to the first transport roller is at a second velocity. The take away roller increases the speed of the media from the first velocity to the second velocity and the first transport roller decreases the speed of the media from the second velocity to a third velocity. Feeding the media from the first transport roller to the second transport roller is done at the third velocity.

The present disclosure in embodiments thereof further provides a control system for feeding media. The control system comprises a take away roller for removing the media from a feed tray at a first velocity. The system further comprises a first transport roller for transporting the media from the take away roller to a second transport roller. The take away roller increases the speed of the media from the first velocity to a second velocity and then decreases the speed of the media from the second velocity to a third velocity. Feeding the media from the take away roller to the first transport roller is done at the third velocity and the feeding of the media from the first transport roller to the second transport roller is done at the third velocity.

The present disclosure still further provides a method for feeding media sheets. The method comprises removing the media from a feed tray with a take away roller, transporting the media from the take away roller to a first transport roller, and then further transporting the media to a second transport roller downstream from the take away roller wherein at least one of the take away and first transport rollers is a variable speed roller.

DETAILED DESCRIPTION

Figure 3:
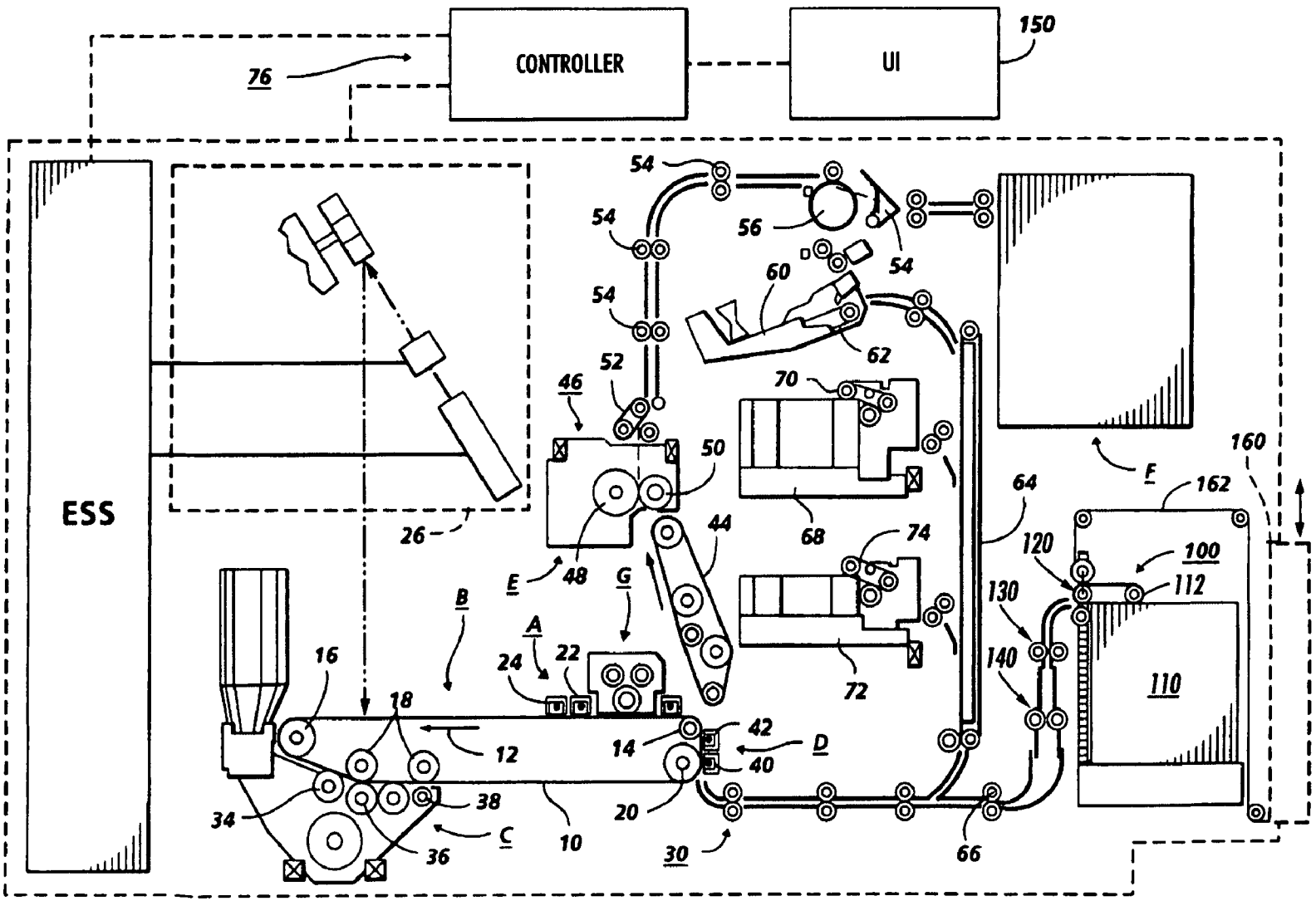

For a general understanding of the features of the present disclosure, reference is made to the drawings. In the drawings, like reference numerals have been used throughout to identify identical elements. FIG. 3 schematically depicts an electrophotographic printing machine incorporating the features of the present disclosure therein. It will become evident from the following discussion that the sheet feeder of the present disclosure may be employed in a wide variety of devices and is not specifically limited in its application to the particular embodiment depicted herein.

Referring to FIG. 3 of the drawings, the electrophotographic printing machine employs a photoconductive belt 10. The photoconductive belt 10 can be made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar™. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated substantially by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At the imaging station, an imaging module indicated substantially by the reference numeral 30, records an electrostatic latent image on the photoconductive surface of the belt 10. Imaging module 30 includes a raster output scanner (ROS) 26. The ROS 26 lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Here, the imaging module 30 can include a laser for generating a collimated beam of monochromatic radiation, an electronic subsystem (ESS), located in the machine electronic printing controller that transmits a set of signals corresponding to a series of pixels to the laser and/or modulator, a modulator and beam shaping optics unit, which modulates the beam in accordance with the image information received from the ESS, and a rotatable polygon having mirror facets for sweep deflecting the beam into raster scan lines which sequentially expose the surface of the belt 10 at imaging station B.

Thereafter, belt 10 advances the electrostatic latent image recorded thereon to development station C. Development station C has three magnetic brush developer rollers indicated substantially by the reference numerals 34, 36 and 38. A paddle wheel picks up developer material and delivers it to the developer rollers. When the developer material reaches rollers 34 and 36, it is magnetically split between the rollers with half of the developer material being delivered to each roller. Photoconductive belt 10 is partially wrapped about rollers 34 and 36 to form extended development zones. Developer roller 38 is a clean-up roller. A magnetic roller, positioned after developer roller 38, in the direction of arrow 12 is a carrier granule removal device adapted to remove any carrier granules adhering to belt 10. Thus, rollers 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detach the copy sheet from belt 10. Conveyor 44 advances the copy sheet to fusing station E.

Fusing station E includes a fuser assembly indicated substantially by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roller is internally heated by a quartz lamp. Release agent, stored in a reservoir, is pumped to a metering roller. A trim blade trims off the excess release agent. The release agent transfers to a donor roller and then to the fuser roller.

After fusing, the copy sheets are fed through a decurler 52. Decurler 52 bends the copy sheet in one direction to put a known curl in the copy sheet and then bends it in the opposite direction to remove that curl. Forwarding rollers 54 then advance the sheet to duplex turn roller 56. Duplex solenoid gate guides the sheet to the finishing station F, or to duplex tray 60. At finishing station F, copy sheets are stacked in a compiler tray and attached to one another to form sets. The sheets are attached to one another by either a binder or a stapler. In either case, a plurality of sets of documents are formed in finishing station F. When duplex solenoid gate diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 facedown on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Secondary tray 68 and auxiliary tray 72 are secondary sources of copy sheets. The high capacity variable sheetpath sheet feeder of the present disclosure, indicated substantially by the reference numeral 100, is the primary source of copy sheets. Further details of the operation of sheet feeder 100 will be described hereinafter with reference to FIGS. 1 and 2 of the drawings. The variable speed path described herein is also applicable to and can be used on secondary feed trays 68 and 72.

The various machine functions are regulated by controller 76. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheetpath sensors or switches may be utilized to keep track of the position of the document and the copy sheets.

Figure 1:
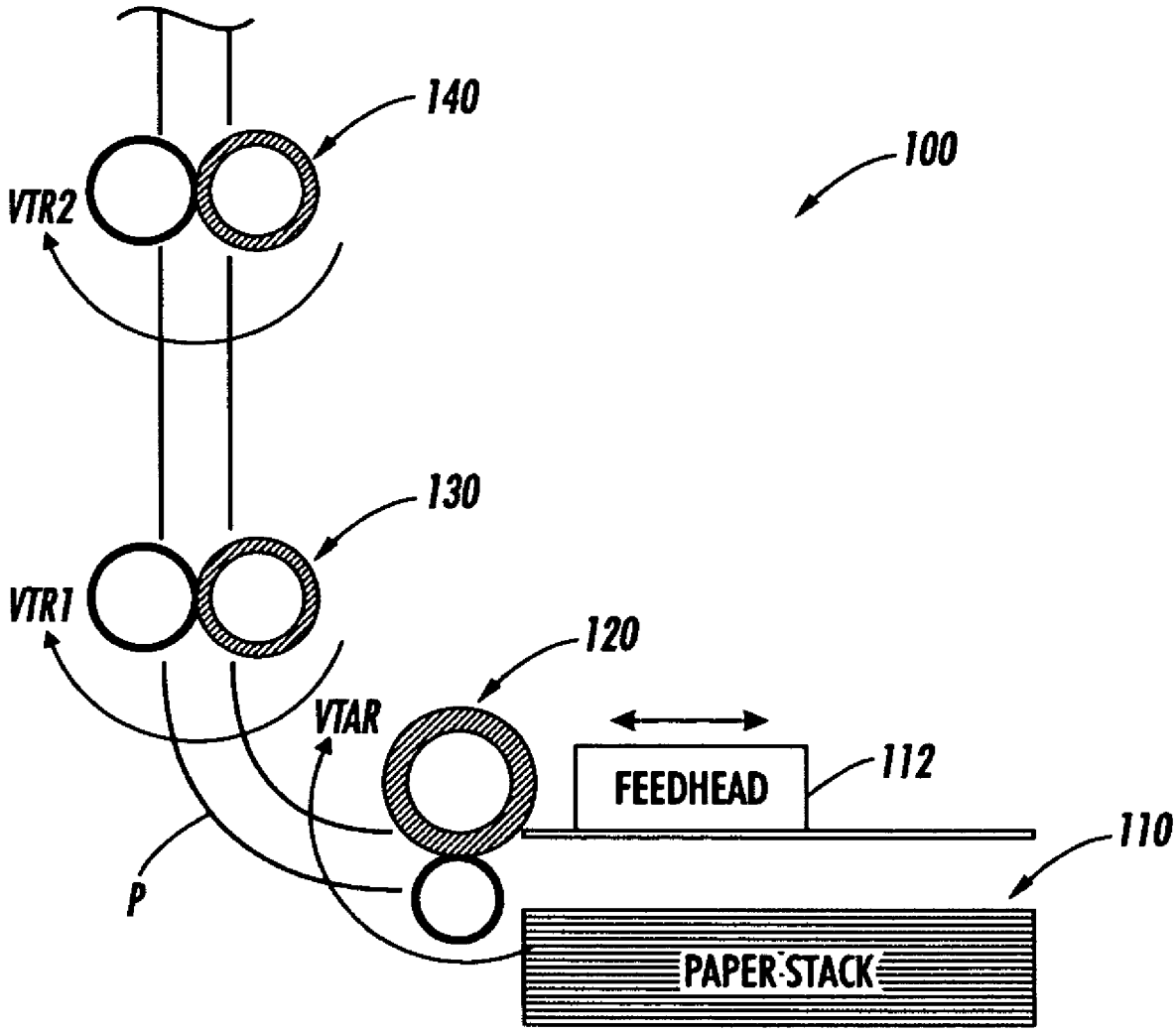
FIG. 1 is a schematic elevational view of the feeder with fixed length sheetpath of the present disclosure.

Turning now to FIG. 1 there is illustrated an isolated schematic diagram of a sheet feeder 100 of the present disclosure. In an integrated printing system, paper or media feeder timing can be driven by one or more print engines. For example, a transport velocity can be some factor (i.e. 1.5 to 2 times) of the print engine process velocity and the feed rate is set by the image to paper rate. These combine to create a set time period during the feed cycle when the sheet or media is taken from the feed tray 110. During this time, the feeder 100 is unable to acquire the next sheet until the trailing edge of the previous sheet clears the feeder. This time delay reduces the amount of time available for the feeder 100 to acquire and separate out single sheets from a stack. The current alternative is to invest a significant amount of development time to ensure that the feeder 100 functions reliably given the available acquisition/separation time.

The present disclosure proposes and describes a system and method for locally speeding up the transport immediately after the feeder exit so that the sheet is rapidly removed from the feeder 100. The sheet can then be slowed down after the trailing edge clears the feeder. The result significantly reduces the delay created by the acquired sheet remaining in the feeder. Since the time needed for sheet acquisition and separation remains the same, the minimum cycle time needed to feed is reduced. Besides allowing a higher feed rate, a local speed-up of the media transport at the feeder exit would allow the rest of the transport to run at a lower speed. This can serve to reduce the power required as well as the noise level created by the product.

In one exemplary arrangement, media or paper feeders can be broken down into several categories such as retard feeder and vacuum corrugated feeders. Feeders can perform at least three basic functions during operation. The first function is sheet acquisition wherein a number of sheets are acquired via a nudger or by vacuum. The second function can include sheet separation wherein one sheet is separated away from other acquired sheets. The third function can include sheet feedout into a paper path wherein the separated sheet can be taken into the paper path.

Feeder technology development can ensure that sheet acquisition and sheet separation function are robust against media and environmental variability. The function of sheet feedout can involve getting the sheet into the paper path quickly enough to meet the desired feed rate. Heretofore, this has been accomplished by speeding up the media transport velocity to ensure that the time available for sheet acquisition and separation is adequate. The media transport velocity can be in the range of 1.5 to 2.0 times the process velocity of the print engine. While the aforementioned approach does work, at the elevated feed rates proposed in some parallel or integrated printing applications the necessary sheet exit velocity would be quite high which could cause a potential noise and component wear issue in the media transport.

The present disclosure proposes an algorithm in which the sheets exiting a feeder can be sped up to the required exit velocity for the time needed to remove the trailing edge of the acquired sheet from the feeder, after which the sheet can be slowed down to the normal or desired transport velocity.

In one example, a vacuum corrugated feeder 100 using the aforementioned algorithm will be described hereinafter. During a feed cycle, a certain amount of time can be specified to allow a sheet on top of the stack to be acquired to a feedhead 112 via vacuum and then be separated out from any other sheets via an air knife. After this time period expires, the feedhead 112 moves the sheet towards a take way roller (TARs) 120. As the leading edge of the sheet enters the TAR nip 120, the vacuum is bled off to ambient allowing a crisp handoff of the sheet which is then taken into the paper path P.

The tangential velocity of the take away roller surface VTAR can be reasonably or substantially close to that of the sheet during hand-off, and the TAR can then be sped up to exit velocity as the sheet enters the paper path P. Once the trailing edge of the sheet clears the area under the feedhead 112, the sheet can then be slowed to a desired transport velocity VTR.

The print rate of a printer/copier can be driven by both the process velocity and the number of images that can be accomplished on the photoreceptor belt or drum. As a result, larger media feeds can be accommodated at a slower rate than the standard A4 or 8.5×11 LEF upon which the published feed rate is based. This can have the beneficial effect of allowing additional time for the paper feeder 100 to perform the sheet acquisition and separation functions. An exit velocity higher than the transport velocity may be needed for small sheets, whereas the large media can feed out acceptably using the transport velocity. Changing the exit velocity relative to the transport velocity for small sheets can be accomplished with the take away roller 120 along with a first and/or a second paper path transport roller 130, 140 downstream of the take away roller 120 having a variable speed capability using variable speed motors.

As one illustrative embodiment, the following is provided. A timing analysis is shown below for a vacuum corrugated feeder which can be used for an integrated parallel printing system. In one example, a sheet can be handed off to the TAR roller 120, which imparts an initial (hand-off) velocity of about 1285 mm/sec and then is sped up to the exit velocity until the sheet trailing edge exits the TAR roller 120. If the exit velocity is higher than the transport velocity, the first paper path roller downstream 130 from the TAR 120 can then slow the sheet down to the transport velocity by the time the leading edge reaches a second paper path roller 140 downstream from the first paper path roller 130.

Referring now to Table 1 below wherein a number of pitches corresponding to a number of images which can fit onto the photoreceptor belt is therein displayed. The maximum sheet process length can also be given, along with the pitch time. In one exemplary embodiment, the desired transport velocity within the substrate feeder module is 1500 mm/sec. In a first timing analysis, the exit velocity (Vex) can be set equal to the transport velocity, and the maximum time available for sheet acquisition and separation (Tacq) can then be calculated. Based on one exemplary arrangement, a minimum Tacq of 80 msec was targeted. As shown in Table 1, Row 1, Tacq for the 6 pitch case is below this target.

TABLE 1

| | | | Exit Velocity = Transport Velocity | | Exit Velocity > Transport Velocity (6P) | |
|---|---|---|---|---|---|---|
| # Pitches | Max Sheet Length (mm) | Pitch Time (msec) | $V_{EX}$ (mm/sec) | $T_{acq}$ (msec) | $V_{EX}$ (mm/sec) | $T_{acq}$ (msec) |
| 6 | 216 | 208 | 1500 | 66.5 (<80) | 2100 | 81.3 |
| 5 | 229 | 250 | 1500 | 99.8 | 1500 | 99.8 |
| 4 | 297 | 312 | 1500 | 116.5 | 1500 | 116.5 |
| 3 | 432 | 416 | 1500 | 130.5 | 1500 | 130.5 |
| 2 | 470 | 624 | 1500 | 313.1 | 1500 | 313.1 |

Figure 2:
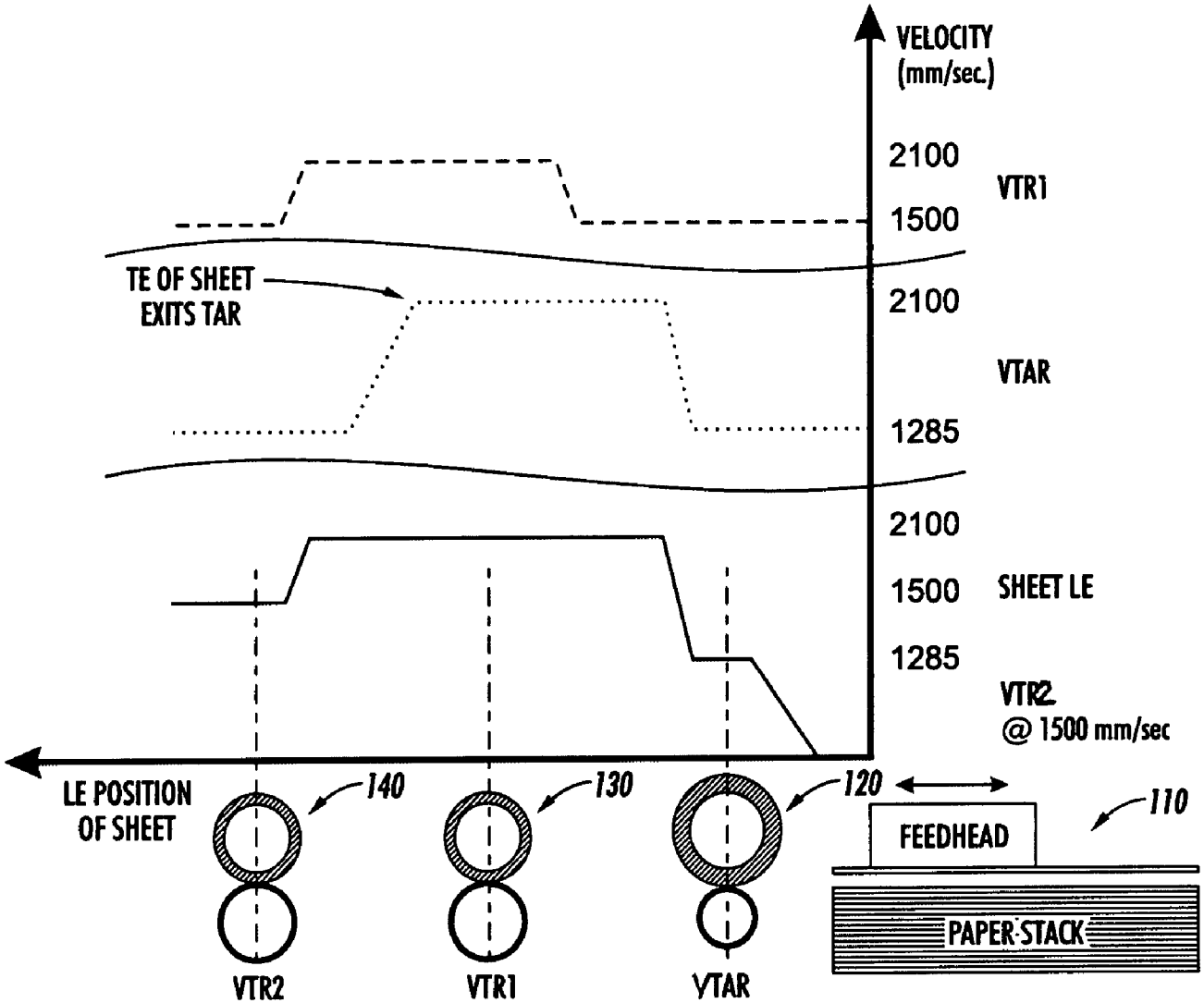
FIG. 2 is a graphical representation of a sheet velocity algorithm through the sheetpath; and, FIG. 3 is a schematic elevational view of an electrophotographic printing machine including the sheetpath of the present disclosure.

In one configuration, the Vex was increased until the Tacq for the 6 pitch case was just over 80 msec. As shown in Table 1, pitches less than 6 were deemed acceptable having a Vex equal to 1500 mm/sec. The take away roller 120 and the first paper path roller 130 can include a variable speed capability using variable speed motors providing for the increases and decreases in sheet velocity. The second paper path roller 140 can be run at a constant speed which reflects the transport (i.e. 1500 mm/sec.). Having a take away roller 120 and one media paper path roller (i.e. 130) running at an elevated speed improves reliability and reduces noise as compared to having three or more rollers running at elevated speeds. FIG. 2 displays the sheet velocity relative to the leading edge LE position for the 6 pitch arrangement.

In another configuration, the take away roller 120 can include a variable speed capability, using variable speed motors, first providing for the increase in sheet velocity from initial sheet hand-off velocity to the exit velocity. Before the lead edge of the sheet arrives at the first roller 130, the take away roller 120 can decrease the sheet velocity to a transport velocity of about 1500 mm/sec. The sheet can then enter roller 130 at substantially this velocity. The first and second paper path rollers 130, 140 can be run at a constant speed (i.e. transport velocity). Having the take away roller (i.e. 120) running at an elevated speed can also improve reliability and reduce noise as compared to having two or more rollers running at elevated speeds. In this arrangement, rollers 120 and 130 are independently controlled.

Referring now to Table 2 below there is displayed the preceding analysis for the arrangement using the take away roller 120 including a variable speed capability by using a variable speed motor. The pitch times are as given in Table 1, and the transport velocity of 1500 mm/sec is also illustrated. In a first timing analysis for this arrangement, the exit velocity (Vex) can be set equal to the transport velocity and the maximum time available for sheet acquisition and separation (Tacq) can then be calculated. Based on one exemplary arrangement, a minimum Tacq of 65 msec was targeted. As shown in Table 2, Row 1, Tacq for the 6 pitch case is below this target.

TABLE 2

| | | | Exit Velocity = Transport Velocity | | Exit Velocity > Transport Velocity (6P) | |
|---|---|---|---|---|---|---|
| # Pitches | Max Sheet Length (mm) | Pitch Time (msec) | $V_{EX}$ (mm/sec) | $T_{acq}$ (msec) | $V_{EX}$ (mm/sec) | $T_{acq}$ (msec) |
| 6 | 216 | 208 | 1500 | 47.6 (<65) | 2100 | 66.3 |
| 5 | 229 | 250 | 1500 | 80.9 | 1500 | 80.9 |
| 4 | 297 | 312 | 1500 | 97.6 | 1500 | 97.6 |
| 3 | 432 | 416 | 1500 | 111.6 | 1500 | 111.6 |
| 2 | 470 | 624 | 1500 | 294.2 | 1500 | 294.2 |

In the second timing analysis, the Vex was increased until Tacq was just over 65 msec. As shown in Table 2, pitches less than 6 were deemed acceptable having a Vex equal to 1500 mm/sec. The take away roller 120 includes variable speed capability, by using a variable speed motor, provided for the initial increase to the exit velocity as well as the decrease to the transport velocity. The first paper path roller 130 and the second paper path roller 140 can be run at a constant speed which reflects the transport velocity (i.e. 1500 mm/sec).

It will be appreciated that various of the above disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system, comprising:

a sheet feeding apparatus for feeding cut sheets in timed relationship into a sheet processor having a pitch;

said sheet feeding apparatus including a fixed take away roller, a first transport roller, and a second transport roller;

said take away roller removing individual cut sheets from a feeder;

a fixed length sheetpath between said take away roller, said first transport roller, and said second transport roller; and, said take away roller and said first transport roller being independently variably driven by variable speed motors between a first velocity, a second velocity, and a third velocity; and, said second transport roller having said third velocity, and wherein said second velocity is greater than said first velocity and greater than said third velocity.

2. The system of claim 1, wherein said third velocity is greater than said first velocity.

3. A printing system comprising:

a sheet feeding apparatus for feeding cut sheets in timed relationship into a sheet processor having a pitch;

said sheet feeding apparatus including a fixed take away roller, a first transport roller, and a second transport roller;

said take away roller removing individual cut sheets from a feeder;

a fixed length sheetpath between said take away roller, said first transport roller, and said second transport roller; and, said take away roller and said first transport roller being independently variably driven by variable speed motors between a first velocity, a second velocity, and a third velocity; and, said second transport roller having said third velocity; and wherein at least said first transport roller is driven at a constant said third velocity.

4. The system of claim 3, wherein said second velocity is greater than said first velocity and greater than said third velocity.

5. A control system for feeding media, said control system comprising:

a take away roller for removing said media from a feed tray at a first velocity;

a first transport roller for transporting said media from said take away roller to a second transport roller;

feeding said media from said take away roller to said first transport roller at a second velocity;

said take away roller increasing said media from said first velocity to said second velocity and then said first transport roller decreasing said media from said second velocity to a third velocity by variable speed motors; and, feeding said media from said first transport roller to said second transport roller at said third velocity; and wherein said third velocity is greater than said first velocity.

6. The control system of claim 5, wherein said third velocity is greater than 1500 mm/sec.

7. The control system of claim 5, wherein said second velocity is from about 1500 mm/sec to about 2100 mm/sec.

8. The control system of claim 5, wherein said second velocity increases from about 1285 mm/sec to about 2100 mm/sec.

9. The control system of claim 5, wherein said second velocity decreases from about 2100 mm/sec to about 1500 mm/sec.

10. A control system for feeding media, said control system comprising:

a take away roller driven by a variable speed motor for removing said media from a feed tray at a first velocity;

a first transport roller for transporting said media from said take away roller to a second transport roller;

said take away roller increasing said media from said first velocity to a second velocity and then decreasing said media from said second velocity to a third velocity;

feeding said media from said take away roller to said first transport roller at said third velocity; and, further feeding said media from said first transport roller to said second transport roller at said third velocity, and wherein said third velocity is greater than said first velocity.

11. The control system of claim 10, wherein said second velocity is greater than 1500 mm/sec.

12. The control system of claim 10, wherein said second velocity is from about 1500 mm/sec to about 2100 mm/sec.

13. The control system of claim 10, wherein said second velocity increases from about 1285 mm/sec to about 2100 mm/sec.

14. The control system of claim 10, wherein said second velocity decreases from about 2100 mm/sec to about 1500 mm/sec.

15. A method for feeding media sheets, said method comprising:

removing said media from a feed tray with a take away roller; and, transporting said media from said take away roller to a first transport roller and then to a second transport roller downstream from said take away roller wherein at least one of said take away roller and said first transport roller is a variable speed roller; and increasing a speed of said take away roller as said media pass therethrough from a first velocity to a second velocity and then decreasing said speed from said second velocity to a third velocity.

16. The method of claim 15, wherein said first transport roller is a variable speed roller.

17. The method of claim 15, further comprising;

transporting said media from said first transport roller to said second transport roller at said third velocity.

18. The method of claim 15, wherein said third velocity is greater than said first velocity.

19. The method of claim 15, wherein said second velocity is greater than 1500 mm/sec.

20. The method of claim 15, wherein said second velocity is from about 1500 mm/sec to about 2100 mm/sec.

21. The method of claim 15, wherein said second velocity increases from about 1285 mm/sec to about 2100 mm/sec.

22. The method of claim 15, wherein said second velocity decreases from about 2100 mm/sec to about 1500 mm/sec.

* * * * *